US007185617B2

(12) United States Patent
Sedda et al.

(10) Patent No.: US 7,185,617 B2
(45) Date of Patent: Mar. 6, 2007

(54) ELECTROMAGNETIC VALVE ACTUATING DEVICE FOR AN INTERNAL COMBUSTION ENGINE

(75) Inventors: Emmanuel Sedda, Conflans Sainte Honorino (FR); Christophe Fageon, Montrouge (FR); Christian Chillet, Grenoble (FR); Jean-Paul Yonnet, Meylan (FR)

(73) Assignees: CNRS Centere National De La Recherche Scientifique, Paris (FR); Peugeot Citroen Automobiles SA, Cedex (FR)

( * ) Notice: Subject to any disclaimer, the term of this patent is extended or adjusted under 35 U.S.C. 154(b) by 0 days.

(21) Appl. No.: 11/067,142

(22) Filed: Feb. 25, 2005

(65) Prior Publication Data

US 2005/0188928 A1 Sep. 1, 2005

(30) Foreign Application Priority Data

Feb. 27, 2004 (FR) ..... 04 50387

(51) Int. Cl.
*F01L 9/04* (2006.01)

(52) U.S. Cl. ..... 123/90.11; 123/90.15; 251/129.06; 251/129.16

(58) Field of Classification Search ..... 123/90.11, 123/90.15
See application file for complete search history.

(56) References Cited

U.S. PATENT DOCUMENTS

| | | | | |
|---|---|---|---|---|
| 4,829,947 | A * | 5/1989 | Lequesne | 123/90.11 |
| 6,216,653 | B1 * | 4/2001 | Hara et al. | 123/90.11 |

FOREIGN PATENT DOCUMENTS

| | | | |
|---|---|---|---|
| DE | 100 12 439 | A1 | 6/2001 |
| EP | 1174595 | A1 * | 1/2002 |
| FR | 2 818 432 | | 6/2002 |
| JP | 6-307214 | | 11/1994 |

* cited by examiner

*Primary Examiner*—Thomas Denion
*Assistant Examiner*—Kyle M. Riddle
(74) *Attorney, Agent, or Firm*—RatnerPrestia

(57) ABSTRACT

The present invention pertains to a valve actuating device for an internal combustion engine, comprising a magnetic blade controlling the position of the valve and cooperating for this purpose with at least one magnetic circuit comprising at least one magnet for attracting the blade alternately toward a first end position in which the valve is in the closed position and a second end position in which the valve is in the open position. A coil with springs controls the displacement of the blade from one end to the other. The magnetic circuit includes two non-coplanar parts, each of which is approximately C-shaped. A first coil surrounds the main branch of the first part and a second coil surrounds the main branch of the second part. At least one magnet connects the lateral faces opposite the two parts. The corresponding ends of the open branches are approximately coplanar.

17 Claims, 6 Drawing Sheets

ELECTROMAGNETIC VALVE ACTUATING DEVICE FOR AN INTERNAL COMBUSTION ENGINE

FIELD OF THE INVENTION

The present invention pertains to an electromagnetic device for actuating a valve (valves) for an internal combustion engine.

BACKGROUND

An internal combustion engine is known to comprise valves, at least one per cylinder, for the admission or the exhaust of gases. These valves are controlled synchronously with the operation of the engine. Their opening or closing time must be controlled very accurately.

Until now, the opening or closing of valves has been carried out mainly mechanically. However, an electromechanical type valve opening or closing control has been proposed for the past few years, which makes it possible to simplify the embodiment of the engine and the supplementary engine control functions because the valves can be controlled at will thanks to electronic control means independently from the structure of the engine.

These electromechanical valve opening and closing control devices comprise a magnetic blade or plate cooperating with one or two electromagnets and springs. The blade moves between the two electromagnets. One end of the course of the blade corresponds to the closed position of the valve and the other end of the course corresponds to the open position. In each end position, one spring is compressed and another spring is relaxed. The electromagnet is used to maintain the blade in each end position while the springs help to displace the blade from one end of its course to the other.

A particularly simple type of actuating device was described in European Patent No. 1 174 596. This device is shown in FIG. 1. A single electromagnet 1, inside of which a permanent magnet 5 is arranged, is provided in this known embodiment. The magnetic circuit of the electromagnet comprises, in a sectional view, symmetrically in relation to the axis of a rod 16, on the one hand, two branches 8 and 9, with the ends of which a magnetic blade 15 comes into contact in the closed position of the valve 17, and, on the other hand, the branches 10 and 11, at the ends of which the blade is supported in the open position of the valve.

The magnetic induction created by the permanent magnet 5 maintains the blade 15 in each of the end positions, either at the end of the branches 8 and 9 or at the ends of the branches 10 and 11.

To pass over from one position into the other, a coil 2 wound around a branch of the magnetic circuit is supplied in such a way as to generate a magnetic field that opposes the effect of the magnet. Under these conditions, the compressed spring pushes the blade 15 toward the other end position. In the position shown in FIG. 1, the compressed spring 18 pushes the blade 15 toward the ends of the branches 10 and 11.

The structure of this actuating device is particularly simple and the electric energy consumption is low. However, this structure has a space requirement that is hardly compatible with the compactness desired for the embodiment of engines. Moreover, start-up is difficult from the mid-course position, which corresponds to the equilibrium position of the springs.

SUMMARY OF THE INVENTION

The object of the present invention is to make it possible to embody an actuating device of the polarized type (i.e., one with a permanent magnet) with a reduced space requirement, which can be easily manufactured in large lots.

The actuating device according to the present invention comprises two, essentially C-shaped ferromagnetic pieces located in different planes and separated by two permanent magnets, whose magnetic fields are approximately parallel and have the same direction, the planes of the two C-shaped ferromagnetic pieces being parallel or forming an acute angle, the blade being arranged in such a way as to be able to move between the ends of the branches of the two C-shaped pieces, and a coil is wound around one branch of each C, preferably around the main branch, the windings of these two coils being in opposite directions.

It is understood that compared with the structure shown in FIG. 1, the space requirement is greatly reduced because the magnetic circuit is folded around the central axis, that of the valve rod, in the structure according to the present invention.

The C-shaped magnetic pieces have good rigidity, which is important for automobile parts.

Since the magnet or the magnets is/are between the C-shaped magnetic pieces, it/they may extend in a larger volume than the prior-art structure. As a result, the remanent field of the magnet (or magnets) may be weaker. In addition, the structure may be such that the magnet can be easily replaced.

The structure of the actuating device is also such that the blade has reduced space requirement and hence reduced weight.

In a preferred embodiment, the C-shaped magnetic pieces are made of laminated sheets.

The present invention pertains, in general, to a valve actuating device for an internal combustion engine, comprising a magnetic blade controlling the position of the valve and cooperating for this purpose with at least one magnetic circuit comprising at least one magnet to attract the blade alternately to a first end position in which the valve is in the closed position and to a second end position in which the valve is in the open position, at least one coil and elastic means, especially spring(s), being intended for controlling the displacement of the blade from one end position into the other, which is characterized in that:

- the magnetic circuit comprises two non-coplanar parts, each of which is approximately C-shaped,
- a first coil surrounds the main branch of the first part,
- a second coil surrounds the main branch of the second part,
- at least one magnet connects the lateral faces opposite the two parts, and
- the two parts are arranged such that the corresponding ends of the open branches are approximately coplanar, the magnetic blade being arranged between the end pairs.

In one example, the device comprises a second magnet connecting the lateral faces opposite the two parts.

The first and/or second coil is located, for example, on a branch located opposite the open branch of the first or second part.

In one embodiment, the magnet (or the magnets) has (have) at least one section (52, 54) that is approximately coplanar with the sections of the two parts of the magnetic circuit.

The two parts of the magnetic circuit are preferably made of laminated sheet.

In one embodiment, the blade has two end parts, each having the same shape and the same dimensions as the corresponding end sections of the open branches of the C-shaped parts of the magnetic circuit.

According to one embodiment, each of the two parts of the magnetic circuit has an approximately flat shape, and these two flat parts, separated by one or two magnets, are approximately parallel. In this case, the two parts of the magnetic circuit may be practically identical and arranged symmetrically in relation to a median plane extending in parallel to these two parts. In a variant, the two full branches of each C-shaped part of the magnetic circuit are located opposite each other in a projection onto a plane extending in parallel to the two parts.

According to one embodiment, each of the two parts of the magnetic circuit has an approximately flat shape, and its two flat parts, separated by one or more magnets and forming between them an acute angle such that the distance between the ends of the open branches of the C is smaller than the distance between the large branches of the C-shaped parts.

According to another embodiment, each of the two C-shaped parts of the magnetic circuit has an essentially flat first section parallel to the corresponding section of the other part, the magnet or the magnets being arranged between these two parallel sections and a second section that is shaped and arranged such that the distance between the ends of the open branches of the C is smaller than the distance between the large branches of the two C-shaped parts.

At least one face of the blade may have at least one shoulder, to which corresponds a shoulder of an end of an open branch of a C-shaped part of the circuit. The shoulder may extend in a rectilinear or curvilinear direction.

The blade may have a general rectangular, orthogonal or circular shape.

The cross section of the magnet or the magnets in contact with the two parts of the magnetic circuit is, for example, larger than the cross section of the ends of the two open branches of the two C-shaped parts of the magnetic circuit.

In one embodiment, the magnet or the magnets is/are made of ferrite.

The present invention also pertains to a set of at least two valve actuating devices arranged such that the coils of the two actuating devices are located at spaced locations from one another.

The present invention also pertains to an internal combustion engine comprising at least one actuating device of the type defined above.

BRIEF DESCRIPTION OF THE DRAWINGS

Other characteristics and advantages of the present invention will appear from the description of some of its embodiments, this description being made in reference to the attached drawings, in which.

DETAILED DESCRIPTION

Figure 2:
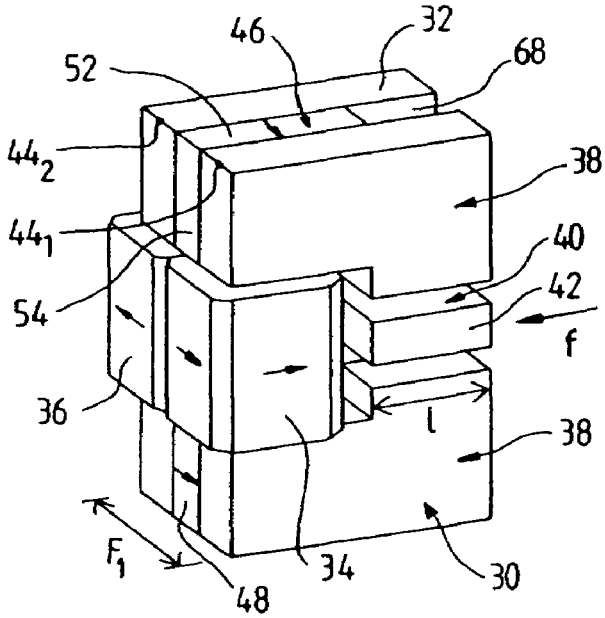
FIG. 2 shows a schematic perspective view of an actuating device according to the present invention.
Figure 3:
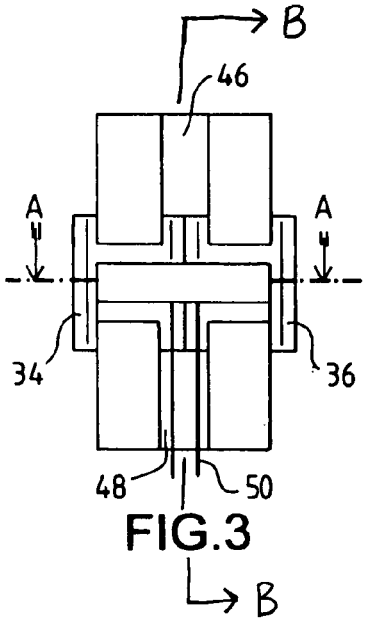
FIG. 3 is a view according to arrow f in FIG. 2, FIGS. 3*a* and 3*b* are sections along lines AA and BB, respectively, in FIG. 3, FIGS. 3*c* and 3*d* are views analogous to those in FIG. 3*a* illustrating a process of optimizing a structure according to the present invention.
Figure 3A:
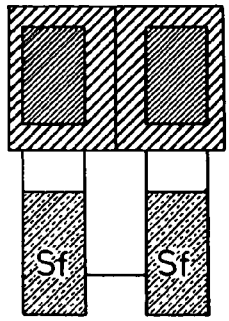
Figure 3B:
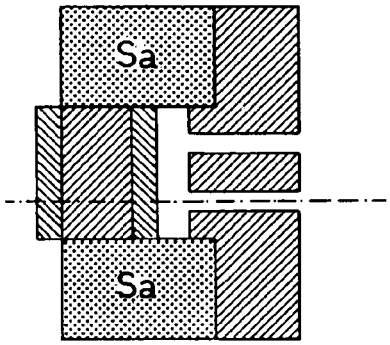

The valve actuator shown in FIGS. 2 and 3 comprises a magnetic circuit formed by two pieces 30 and 32, each of which has the general shape of a C. These two magnetic pieces 30 and 32 are made of a laminated sheet and are identical. Each of them comprises a central branch around which is wound a coil 34, 36. These two coils have windings which generate magnetic fields in opposite directions.

The open branch 38 of the C forms a space in which a magnetic blade 42 intended to move in that space (air gap) 40 in a direction parallel to the main branches of the C is arranged.

Figure 1:
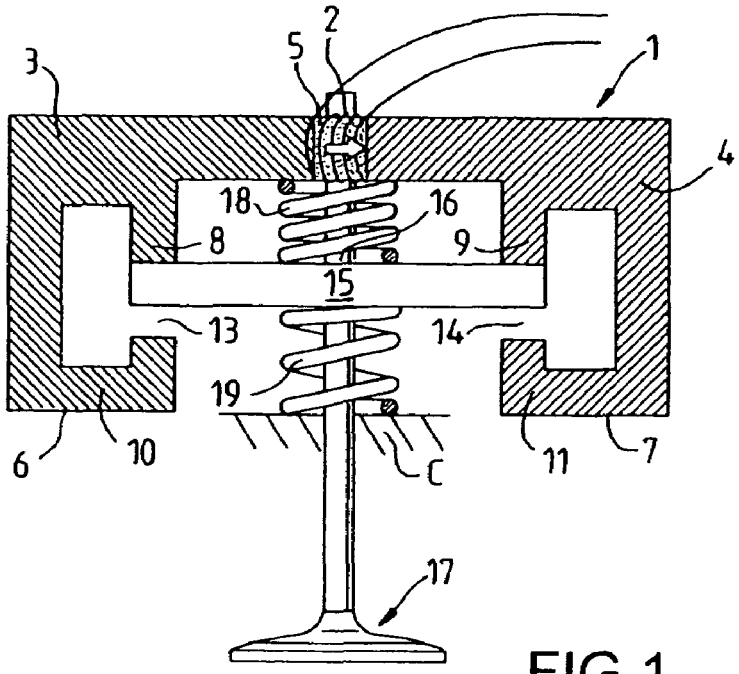
FIG.1 PRIOR ART
FIG. 1, already described, corresponds to a prior-art structure of an actuator device.

This blade cooperates with rods and a valve stem as well as with springs as described in connection with FIG. 1. These components are consequently not shown in FIGS. 2 and 3.

The two pieces 30 and 32 have flat lateral faces. They are arranged in parallel to one another and, in this example, such that the four edges of the section are aligned. For example, the edge $\mathbf{44}_1$ of the piece 30 is aligned with the edge $\mathbf{44}_2$ of the piece 32.

Between the faces located opposite the pieces 30 and 32, the actuating device comprises two permanent magnets 46 and 48, respectively, which are identical and whose magnetization is in the same direction. Each of the magnets has a section in the same plane as the upper or lower section of the C-shaped pieces. Thus, the upper section 52 of the magnet 46 is coplanar with the upper sections of the pieces 30 and 32, and the external vertical section 54 of the magnet 46 is coplanar with the external vertical section of the C-shaped pieces 30 and 32.

The two magnets 46 and 48 play a similar role in the generation of the magnetic polarization field. In a variant, a single magnet (for example, 46) is used, which can be embodied by a single magnet or by a plurality of magnets magnetized in the same direction.

A particularly compact structure is thus obtained because the C-shaped magnetic pieces 30 and 32 can be formed from relatively thin plates. The magnets 46 and 48 also have a moderate thickness. This device can be easily manufactured industrially by manufacturing magnetic pieces from a laminated material. It is possible to use magnets with a relatively weak remanent field because, compared with the magnet shown in FIG. 1, they occupy a considerably larger volume. In addition, the magnets are not surrounded by coils 34 and 36 in the structure shown in FIG. 2 and are accessible from the outside of the structure. As a result, they can be easily replaced.

If the actuator is installed in the direction shown, its space requirement in direction $f_1$ (FIG. 2) is small, which makes it possible to use it combined with another actuator of the same type for an engine with multiple valves, in which the distance between the valves is relatively short. In addition, the structure is such that the blade 40 has reduced space requirement and therefore low weight, which minimizes the amount of energy needed for the operation of the device.

One advantage of making the magnetic pieces 30 and 32 of laminated sheet is the fact that the induction generated by the coils 34 and 36 is in the plane of these sheets (as is shown in FIG. 2) and the currents induced are consequently in the perpendicular direction, i.e., they are intersected by the open circuits between sheets.

FIG. 3 shows the rod 50 made integral with the blade 42, which cooperates with the valve stem (not shown in FIGS. 2 and 3).

The operation of the device described in connection with FIGS. 2 and 3 will now be described on the basis of FIG. 4.

Figure 4:
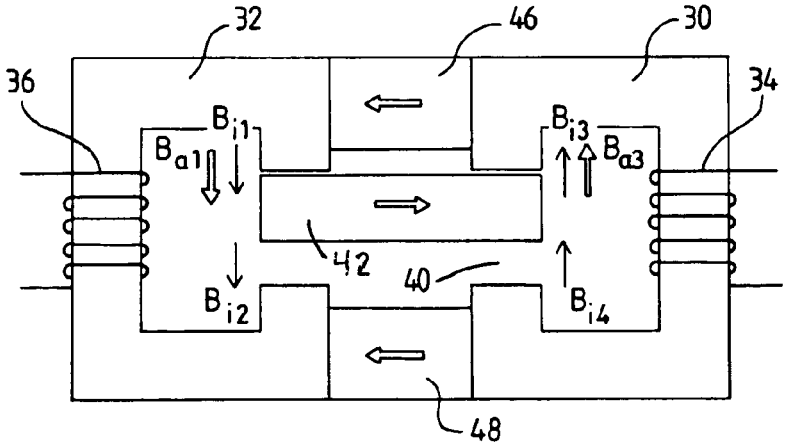
FIG. 4 is a schematic diagram intended to explain the operation of the device shown in FIGS. 2 and 3.

The two magnetic pieces 30 and 32 are shown in this FIG. 4 in the same plane and the magnets 46 and 48 between the magnetic pieces 30 and 32 are also shown in the same plane.

The magnetic fields generated by the magnets 46 and 48 are indicated by double arrows, while the magnetic fields generated by the coils 34 and 36 are indicated by a single arrow.

It is seen that the magnetic fluxes generated by the magnets add up in the blade 42. Thus, when the blade 42 is in the high position (in FIG. 4), the magnetic polarization circuit (formed by the two magnets) is completely closed and the magnetic induction $B_\alpha$ has its maximum, whereas the magnetic induction generated by the magnets is zero in the lower air gap, between the blade 42 and the C-shaped circuits 30 and 32.

As above, the magnets 46 and 48 play a similar role in the generation of the magnetic polarization field. As a consequence, a single magnet (for example, 46) is used, which can be formed by a single magnet or by a plurality of magnets magnetized in the same direction.

The magnetic flux generated by the coils 34, 36 passes across the closed air gap and an air gap 4O having a size on the order of magnitude of 8 mm. As a result, the induction generated by the coils remains weak but sufficient to permit the operation. Moreover, part of the flux of the coils is closed directly between the laminated magnetic circuits at the level of the magnets 45 and 48.

Figure 5:
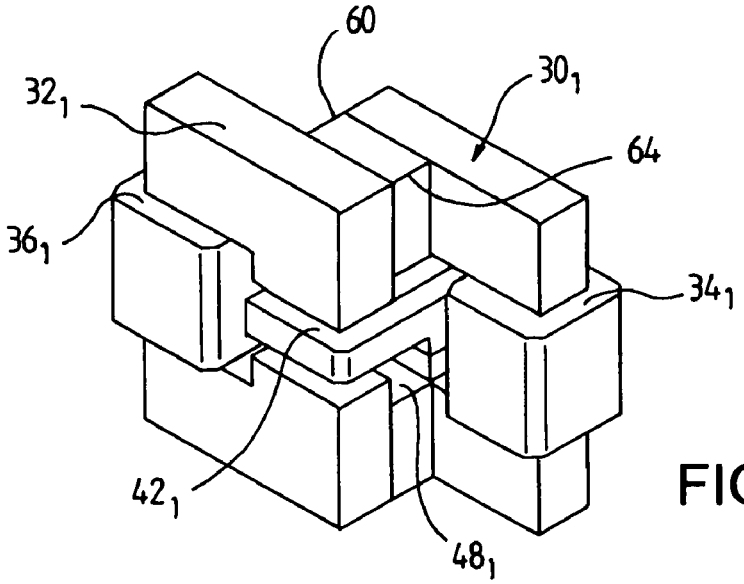
FIG. 5 shows a schematic perspective view analogous to that in FIG. 2 for a variant of the device according to the present invention.

FIG. 5 shows a variant in which the two C-shaped magnetic circuits $\mathbf{30}_1$ and $\mathbf{32}_1$ are flat pieces, likewise made of laminated sheet, just as in the embodiment shown in FIGS. 2 and 3, and these flat pieces are located in approximately parallel planes. However, contrary to the embodiment shown in FIGS. 2 and 3, the main branches are not brought close to one another but opposite. This is also true of the coils $\mathbf{34}_1$ and $\mathbf{36}_1$.

The magnets $\mathbf{46}_1$ and $\mathbf{48}_1$ have approximately the width of the C-shaped open branches and connect the faces opposite these Cs. Thus, magnet $\mathbf{46}_1$ has an upper edge 60 aligned with the upper edge 62 of the pieces $\mathbf{30}_1$ of the side of the open branch of the C. The other upper edge 64 of the magnet $\mathbf{46}_1$ is analogously aligned with the upper edge 66 of the side of the C of piece $\mathbf{32}_1$.

The magnet $\mathbf{48}_1$ is arranged analogously to the magnet $\mathbf{46}_1$. However, it has an opening (not shown) for allowing the valve stem or the rod of the blade $\mathbf{42}_1$ to pass through, the stem or the rod likewise not being shown in FIG. 5.

Compared with the embodiment shown in FIGS. 2 and 3, the magnetic pieces are farther apart from one another, which diminishes the magnetic field leakage. In fact, magnetic leakage may develop in the embodiment shown in FIG. 2 between the parts 68 of the pieces 30 and 32, which are not separated by the magnets 46 and 48.

Thus, due to the reduction of the leakage, the blade $\mathbf{42}_1$ will be maintained against the magnetic pieces more effectively than in the embodiment shown in FIG. 2. However, a stronger current will therefore be necessary for passing over from the open state into the closed state and vice versa.

Figure 6:
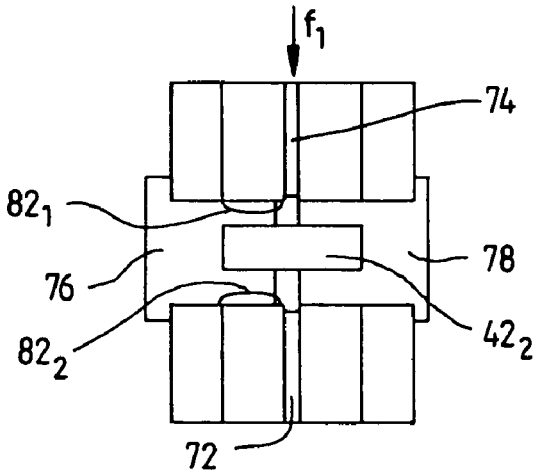
FIG. 6 shows a view analogous to that in FIG. 3 of a second variant.
Figure 7:
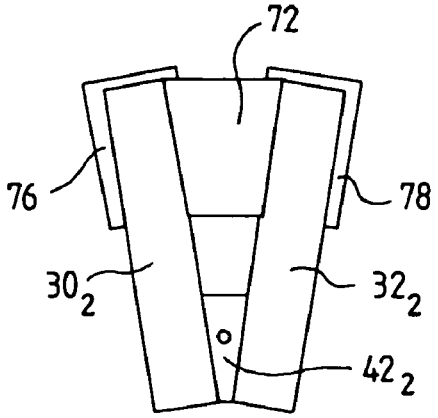
FIG. 7 shows a view according to arrow $f_1$ in FIG. 6.
Figure 8:
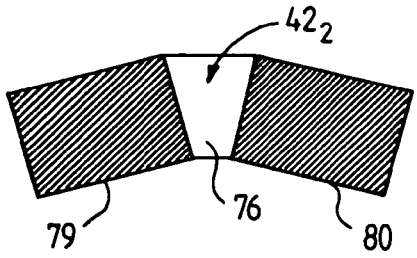
FIG. 8 shows an embodiment of a blade for the device shown in FIGS. 6 and 7.

The embodiment shown in FIGS. 6, 7 and 8 is distinguished from that shown in FIGS. 2 and 3 by the fact that the magnetic pieces $\mathbf{30}_2$ and $\mathbf{32}_2$ are not parallel but form an acute angle so that they are brought closer to the open branch of the C in order to minimize the dimension and consequently the weight of the blade $\mathbf{42}_2$. Two magnets with a trapezoidal shape in the section extending in parallel to the flat part of the blade are provided in this example. These magnets are designated by the reference numbers 72 and 74.

As in the other examples, the coils 76 and 78 are wound around the central part of the full branch of each C-shaped piece.

As is shown in FIG. 8, the blade $\mathbf{42}_2$ has, in the example, a shape in the drawing adapted to that of the ends opposite the open branches of the C-shaped pieces. Thus, the piece $\mathbf{42}_2$ has a central part 76 of a trapezoidal shape, whose nonparallel sides are the short sides of rectangles 78 and 80, respectively. The rectangle 78 corresponds to the opposite ends $\mathbf{82}_1$, $\mathbf{82}_2$ of the open branches of the C of the piece $\mathbf{30}_2$, and the rectangle 80 corresponds to the corresponding ends for the piece $\mathbf{32}_2$.

Thus, the weight of the blade can be further reduced by the optimization of the surfaces opposite the magnetic circuits.

The small space requirement of the blade makes it possible to install the valve actuating device for engines in which the space between valves is small. The output of the actuating device can also be maximized with this embodiment for a given center-to-center distance between valves. In addition, the magnets are thick, which makes it possible to confer strong holding forces of the magnets in the open position of the valve or in the closed position of the valve.

Figure 9:
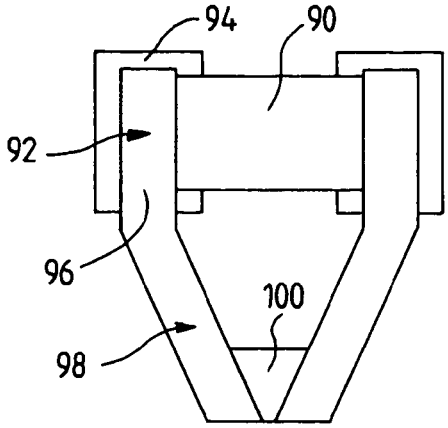
FIG. 9 shows a view analogous to that in FIG. 7 of a variant.
Figure 10:
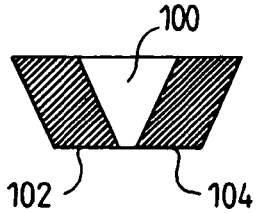
FIG. 10 shows a blade for the device shown in FIG. 9, FIG. 11 also shows a view analogous to that in FIG. 6 of yet another variant, FIG. 12 also shows a view analogous to that in FIG. 6 of another variant.

The example shown in FIG. 9 pertains to another variant, in which parallelepipedic magnets 90 are formed in such a way that each C-shaped circuit has two parts forming between them an obtuse angle, namely, a first part 92 comprising the full branch around which is wound the corresponding coil 94 and the beginning 96 of the perpendicular branches, and, on the other hand, a part 98 comprising the open branch of the C (not shown), between which the blade 100 moves (FIGS. 9 and 10).

The blade 100 has a trapezoidal shape as is shown in FIG. 10, its two ends corresponding to the ends being in the form of parallelograms 102 and 104 of the free ends of the open branches of the C.

This embodiment shown in FIGS. 9 and 10 has the same advantages as that shown in FIGS. 6, 7 and 8. However, the embodiment of the magnet is simpler.

Figure 11:
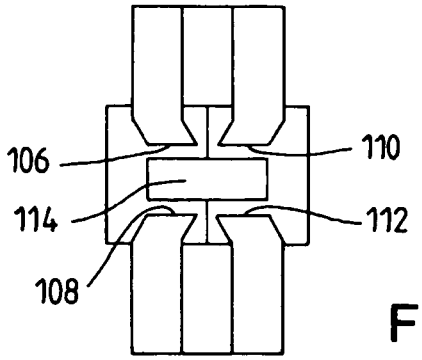

The exemplary embodiment shown in FIG. 11 is distinguished from that shown in FIG. 3 by the fact that the ends 106, 108 and 110, 112 of the open branches of each C-shaped magnetic piece form beaks in order for these ends to be closer to one another than the magnetic pieces. Under these conditions, the blade 114 may have a smaller dimension.

Figure 12:
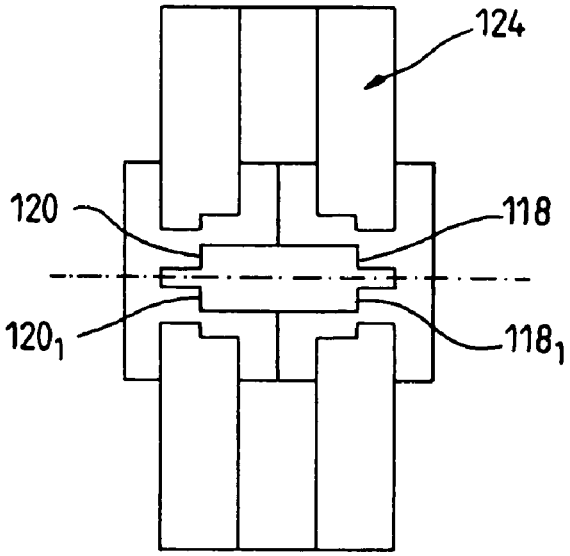
Figure 13:
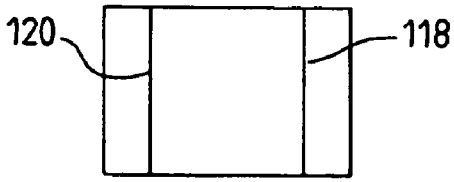
FIG. 13 shows a blade for the device according to FIG. 12.
Figure 14:
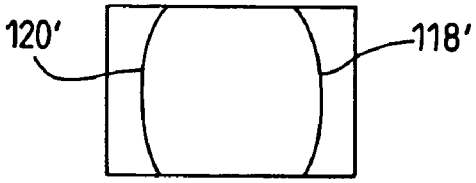
FIG. 14 shows another blade configuration for the device according to FIG. 12.

In the examples shown in FIGS. 12, 13 and 14, the magnetic blade 116 has shoulders 118 and 120 and the ends of the open branches of the C-shaped pieces comprise corresponding shoulders. The purpose of this arrangement is to linearize the force of attraction of the magnetic pieces on the blade 116 as a function of the air gap.

Thus, the blade 116 has a greater thickness in its central parts and smaller thicknesses at the ends, thus forming four shoulders 118, 120, $\mathbf{118}_1$ and $\mathbf{120}_1$.

The ends of the C-shaped magnetic pieces have complementary shoulders. Thus, the end 122 of one of the open branches 124 of a C-shaped magnetic piece 126 has a shoulder 128 intended to be located opposite the corresponding shoulder 118 when the blade is attracted upwards.

In the example shown in FIG. 13, the shoulders 118, 120 as well as the shoulders $\mathbf{118}_1$ and $\mathbf{128}_1$ are rectilinear, whereas the shoulders 118', 120; are curved in the example shown in FIG. 14. This also applies, of course, to the corresponding shoulders on the ends of the "C"-shaped magnetic pieces.

With the embodiment shown in FIG. 14, the blade is no longer susceptible to angular offsets of this blade.

In a variant, a plurality of shoulders forming stairs and/or a plurality of V-shaped shoulders are formed on the blade and the ferromagnetic circuits.

Figure 15:
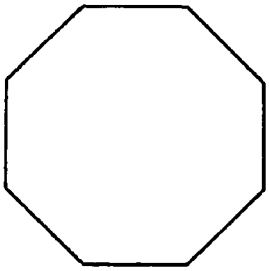
FIG. 15 shows another blade embodiment that can be used for the actuating devices according to the present invention.

The shape of the blade is, of course, not limited to that described. Thus, FIG. 15 shows another example, in which the blade has an octagonal section. Such an octagonal blade is also preferred to a rectangular blade because it can be shown with such a geometry that at equal weight, the forces exerted on the blade are stronger than in the case of a blade of rectangular shape. The weight of the blade can thus be reduced at equal force of attraction.

FIGS. 3*a*, 3*b*, 3*c* and 3*d* illustrate arrangements that make it possible to use magnets with weak remanent magnetization, especially ferrite magnets, while still generating high induction levels in the magnetic circuit and in the air gap, in order to optimize the force of attraction and to minimize the weight of the magnetic circuit.

The principle of flux concentration is used for this purpose, which consists of conferring a magnet cross section $S_a$ (FIG. 3*b*) that is larger than the cross section of the ferromagnetic circuits $S_f$ (FIGS. 3*a*, 3*c* and 3*d*) and that of the air gaps.

Figure 3C:
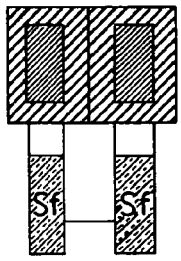
Figure 3D:
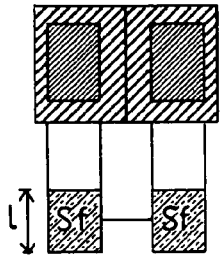

C-shaped magnetic parts of reduced thickness are used in the example shown in FIG. 3*c*, and the width I of the ends of the open branches (the width I being the dimension in the direction perpendicular to the large branch of the C) is reduced in the example shown in FIG. 3*d*.

Thus, the length of the blade is reduced in the example shown in FIG. 3*c* in the same proportions as the distance between the external lateral faces of the two magnetic pieces.

Figure 16:
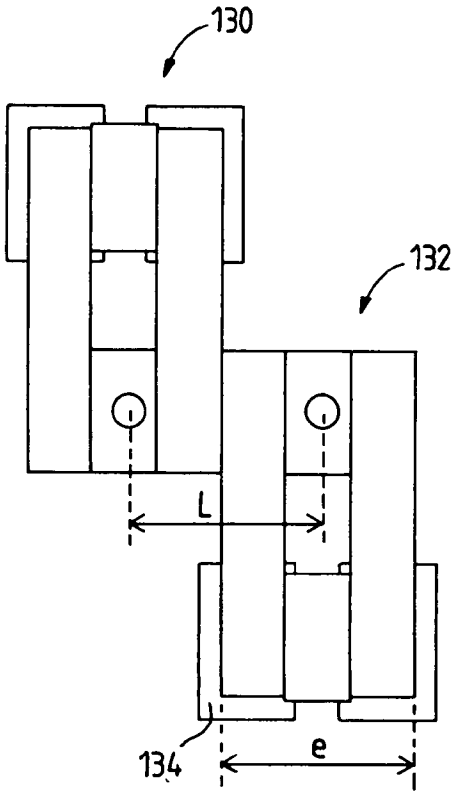
FIG. 16 shows a structure according to the present invention in which two actuating devices according to the present invention are used.

FIG. 16 shows two control devices of the type of those described in connection with FIGS. 2 and 3, one of which, 130, is intended to control a first valve and the other of which, 132, is intended to control a second valve in the vicinity of the first one. These two control devices are arranged in such a way that the planes of the magnetic pieces are parallel. However, the main branches of the magnetic circuits and consequently the coils are in opposite positions. Thus, the distance L between the axes of the two valves controlled by the devices 130 and 132 is approximately equal to the thickness e of a control device without taking into account the excess thickness of the coils 134. The thickness e is the distance between the external faces of the two magnetic pieces of a control device.

Figure 17:
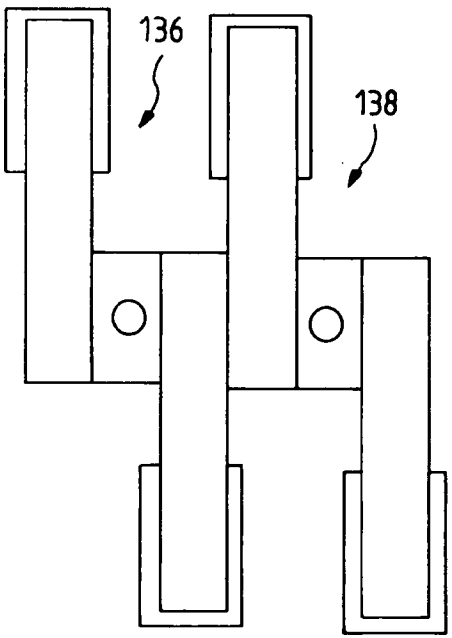

FIG. 17 is a figure analogous to FIG. 16, but two control devices 136 and 138 of the type of those shown in FIG. 5 are provided in this case.

Figure 18:
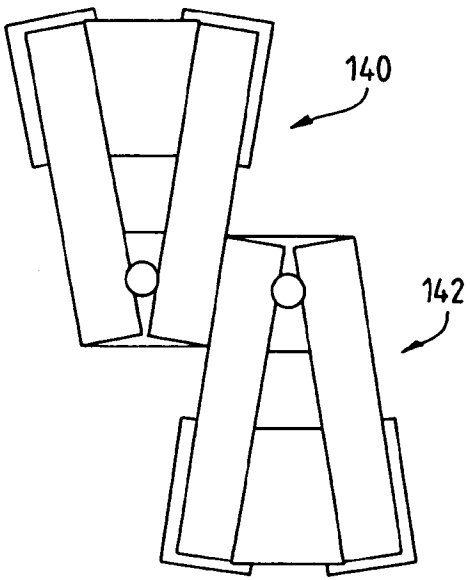
FIGS. 17 and 18 show views analogous to those in FIG. 16 of variants.

FIG. 18 shows two control devices 140 and 142 of the type of those shown in FIGS. 6 and 7. It is seen that compared with FIGS. 16 and 17, the distance between the two valves can be reduced considerably. This embodiment is therefore of particular interest for equipping an engine with small displacement or for obtaining strong forces, for example, in the case of actuators for the exhaust gas.

The invention claimed is:

1. A valve actuating device for an internal combustion engine, comprising a magnetic blade controlling the position of the valve and cooperating for this purpose with at least one magnetic circuit comprising at least one magnet for attracting the blade alternately toward a first end position, in which the valve is in the closed position, and a second end position, in which the valve is in the open position; at least one coil and elastic means for controlling the displacement of the blade between the first and second end positions wherein:

the magnetic circuit comprises two non-coplanar parts arranged in parallel to one another, each of which being approximately C-shaped, a first coil surrounds a main branch of the first part, a second coil surrounds a main branch of the second part, the at least one magnet connects the lateral faces opposite the two parts, and the two parts are arranged such that corresponding ends of the open branches are approximately coplanar, the magnetic blade being arranged between the corresponding ends.

2. A device in accordance with claim 1, wherein the magnetic circuit further comprises a second magnet connecting the lateral faces opposite the two parts.

3. A device in accordance with claim 1 or 2, wherein at least one of the first or second coil is arranged on a branch opposite the open branch of the first or second part.

4. A device in accordance with claim 1 or 2, wherein the at least one magnet has at least one section that is approximately coplanar with the sections of the two parts of the magnetic circuit.

5. A device in accordance with claim 1 or 2, wherein the two parts of the magnetic circuit are made of laminated sheets.

6. A device in accordance with claim 1 or 2, wherein the blade has two end parts, each of which has a shape and dimensions that match the corresponding end sections of the open branches of the C-shaped parts of the magnetic circuit.

7. A device in accordance with claim 1 or 2, wherein each of the two parts of the magnetic circuit has an approximately flat shape and the two flat parts, separated by one or two magnets, are approximately parallel.

8. A device in accordance with claim 7, wherein the two parts of the magnetic circuit are substantially identical and are arranged symmetrically in relation to a median plane extending in parallel with the two parts.

9. A device in accordance with claim 7, wherein the two full branches of each C-shaped part of the magnetic circuit are located opposite each other in a projection onto a plane extending in parallel with the two parts.

10. A device in accordance with claim 1 or 2, wherein at least one face of the blade has at least one shoulder, corresponding to a shoulder of an end of an open branch of a C-shaped part of the circuit.

11. A device in accordance with claim 10, wherein the shoulder extends in a rectilinear direction.

12. A device in accordance with claim 10, wherein the shoulder extends in a curvilinear direction.

13. A device in accordance with claim 1 or 2, wherein the blade has a general rectangular, orthogonal or circular shape.

14. A device in accordance with claim 1 or 2, wherein the cross section of the at least one magnet in contact with the two parts of the magnetic circuit is larger than respective cross sections of the ends of the two open branches of the two C-shaped parts of the magnetic circuit.

15. A device in accordance with claim 1 or 2, wherein the at least one magnet is made of ferrite.

16. A set of at least two valve actuating devices in accordance with claim 1 or 2, wherein the at least two devices are arranged in such a way that the coils of the two actuating devices are located at spaced locations from one another.

17. An internal combustion engine comprising at least one actuating device in accordance with claim 1 or 2.

* * * * *

UNITED STATES PATENT AND TRADEMARK OFFICE

CERTIFICATE OF CORRECTION

PATENT NO. : 7,185,617 B2
APPLICATION NO. : 11/067142
DATED : March 6, 2007
INVENTOR(S) : Emmanuel Sedda et al.

It is certified that error appears in the above-identified patent and that said Letters Patent is hereby corrected as shown below:

On the Cover Page, FIELD [75], Inventors, delete "Emmanuel Sedda, Conflans Sainte Honorino (FR)" and insert --Emmanuel Sedda, Soisy Sous Montmorency, (FR)--

At column 5, line 49, delete "4O" and insert --40--

At column 5, line 54, delete "45" and insert --46--

Signed and Sealed this

Twenty-sixth Day of June, 2007

JON W. DUDAS
*Director of the United States Patent and Trademark Office*